United States Patent [19]

Moser et al.

[11] 3,941,248

[45] Mar. 2, 1976

[54] CHILDPROOF PACKAGING FOR TABLETS

[75] Inventors: Theo Moser, Neckarrems; Dieter Liede, Moglingen, both of Germany

[73] Assignee: Robert Bosch Verpackungsmaschinen G.m.b.H., Waiblingen, Germany

[22] Filed: Sept. 6, 1973

[21] Appl. No.: 394,770

[30] Foreign Application Priority Data

May 2, 1973 Germany ..... 2322055

[52] U.S. Cl. ..... 206/531; 206/484; 206/532; 206/498; 206/820

[51] Int. Cl.[2] ..... B65D 83/04; B65D 85/56

[58] Field of Search ..... 206/42, 484, 498, 820, 206/532, 531

[56] References Cited

UNITED STATES PATENTS

| | | | |
|---|---|---|---|
| 3,503,493 | 3/1970 | Nagy | 206/484 |
| 3,621,992 | 11/1971 | Osborne | 206/532 |
| 3,780,856 | 12/1973 | Braverman | 206/42 |
| 3,809,220 | 5/1974 | Arcudi | 206/42 |
| 3,809,221 | 5/1974 | Compere | 206/498 |

FOREIGN PATENTS OR APPLICATIONS

| | | | |
|---|---|---|---|
| 577,151 | 5/1946 | United Kingdom | 206/820 |
| 1,398,922 | 4/1965 | France | 206/820 |

*Primary Examiner*—William T. Dixson, Jr.
*Attorney, Agent, or Firm*—Edwin E. Greigg

[57] ABSTRACT

A childproof design for packages for tablets, pills and the like includes a conventional base foil provided with indentations or cups to receive the tablets. A cover foil is provided, as a seal, over the base foil. The package is rendered tamperproof by the inclusion of cavities in the base foil within which the cover foil can be grasped and peeled off but which are concealed and inaccessible until an individual tablet package is severed from the whole pack.

1 Claim, 7 Drawing Figures

CHILDPROOF PACKAGING FOR TABLETS

BACKGROUND OF THE INVENTION

1. Field of the Invention

This invention relates to the childproof packaging for tablets, especially to tear-open packages which include a lower base foil and a cover foil. The invention relates, more particularly, to packaging for tablets of the tear-open type which includes a lower base foil made of thermoplastic synthetic material and having deep-drawn cups for receiving tablets, dragees or the like, and also a cover foil which closes off the cups. The cover foil is sealed to the base foil. To facilitate the grasping and release of the cover foil from the base foil, the base foil is provided with concealed grasping recesses.

2. Description of the Prior Art

In a known package of the kind formed by two foils, grasping recesses are pressed into the front of the base foil, and these recesses are further delimited by the cover foil. Thus, the cover foil is easily accessible and can be stripped off without difficulty so that the desired tablet may be removed effortlessly (German Federal Republic Gebrauschsmuster No. 1,927,967). This desired easy opening of the package brings with it the disadvantage, however, of unauthorized removal, especially by children. On the other hand, if the package were manufactured without the grasping recesses and the cover foil were sealed to the base foil around its entire periphery, such a package could not be opened without implements.

OBJECTS AND SUMMARY OF THE INVENTION

It is an object of the invention to provide a tear-open package of the kind described above which is equipped with grasping recesses for the easy grasping and removing of the cover foil, and which is protected to a high degree against unauthorized opening, particularly by children, yet which retains the advantage of easy grasping and removal of the cover foil.

To attain the above-stated object, as well as others which are to become clear from the text below, the invention proposes to develop and conceal the grasping recesses in such a way that the cover foil cannot be grasped without additional action. For this purpose, the grasping recesses are advantageously formed by one or several cavities which are covered by the same cover foil which also covers the cups fot the tablets. Furthermore, the device is made so that the cavities are provided with lines of reduced strength, for example cuts or the like, which define and limit the grasping recesses. Such cuts in the cavities can be formed in known fashion by perforations, notches, scratches or the like provided for the easy separation of an individual tablet package from the package strip or composite of individual packages. Furthermore, it is preferred that one cavity for the formation of a grasping recess is assigned to each sealed tablet in a tablet package and that it is disposed or formed so as to be concealed. However, the package can be made in such a way that the cavities for the formation of grasping recesses are disposed between two or in the center of four tablets. A package of this kind provides very good protection against unauthorized opening and removal of tablets by children. Furthermore, this package also has the advantage of easy opening. This easy opening, however, is made possible only after an individual tablet package has been severed from another package or from the package strip. After the individual package has been severed, the cover foil can be easily grasped by means of the now revealed grasping recess and therefore can be easily stripped from the base foil.

BRIEF DESCRIPTION OF THE DRAWING

The invention is further explained with the aid of the drawing, in which.

DESCRIPTION OF THE PREFERRED EMBODIMENTS

Figure 1:
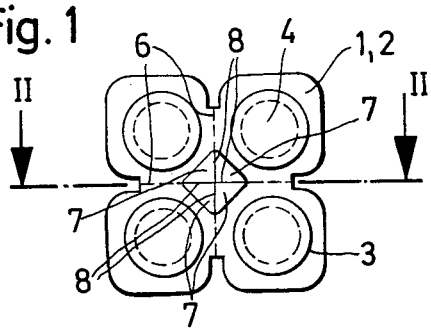
FIG. 1 is a top view of a first exemplary embodiment of the childproof package according to the present invention.
Figure 2:
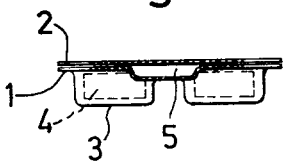
FIG. 2 is a sectional side view of the package illustrated in FIG. 1, the section being taken along the line II—II of FIG. 1.

As is shown in FIGS. 1 and 2, a childproof package, according to the present invention, consists substantially of a base foil 1 and a cover foil 2 connected to the base foil 1 by sealing. Four symmetrically disposed cups 3 are provided in the base foil 1 by a process of deep drawing. These cups 3 serve as receptacles for tablets 4 or the like. Furthermore, the base foil 1 is provided with a cavity 5 in the center of the four symmetric cups 3. This cavity 5 is covered by the cover foil 2 just as are the cups 3. Furthermore, the package is provided with perforations 6 or the like, which serve for the easy separation of individual packages from the entire package. These perforations 6, which may be present either only in the base foil 1 or also in the cover foil 2, result in cuts 8 within the cavity 5, defining grasping recesses 7.

Figure 4:
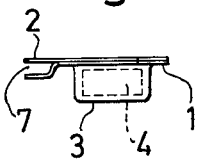
FIG. 4 is a side view of a single tablet package.
Figure 3:
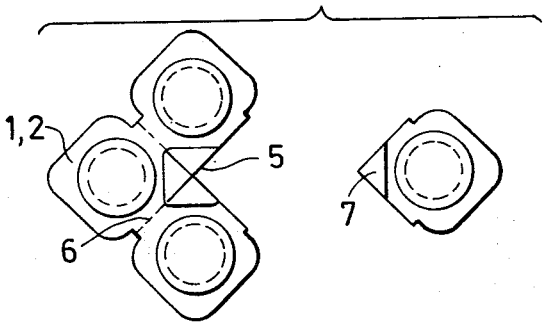
FIG. 3 is a top view of the package illustrated in FIGS. 1 and 2, showing the removal of a single tablet package from the quadruple package or four-pack.

If, as is shown in FIG. 3, an individual package is separated from the entire package, a grasping recess 7 is revealed, so that, as may be best seen in FIG. 4, the cover foil 2 can be easily grasped and stripped from the base foil 1.

The entire package may contain more than four tablets but in that case, their number preferably is enlarged by four tablets at a time so that, for example, packages of eight or twelve tablets result, and one cavity 5 is provided in the center of each set of four symmetrically disposed cups 3 containing the tablets 4.

Figure 5:
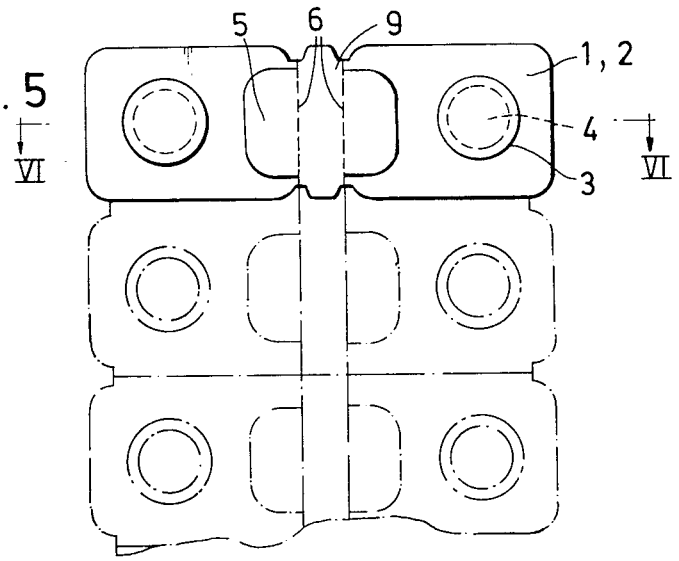
FIG. 5 is a top view of a second exemplary embodiment of a childproof package according to the invention.
Figure 6:
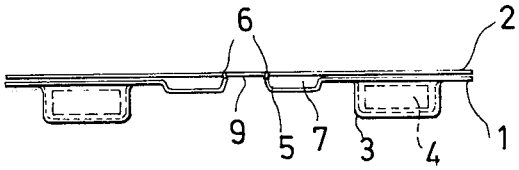
FIG. 6 is a sectional side view of the package illustrated in FIG. 5, the section being taken along the line VI—VI in FIG. 5.
Figure 7:
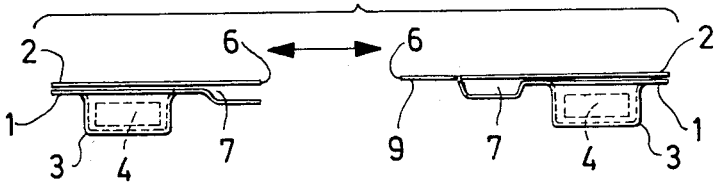
FIG. 7 shows the division of the double package illustrated in FIG. 6.

In a second embodiment of the invention, the childproof package can be developed according to FIGS. 5, 6 and 7 in such a way that an individual grasping recess 7 in the form of a cavity 5 is assigned to each cup 3 containing a tablet 4. In this arrangement, perforations 6 or the like are disposed so that when one of the cups 3 containing a sealed-in tablet 4, is separated from the entire package or from a second one of the cups 3, containing another sealed-in tablet 4, the grasping recess 7 of the severed single package is revealed and the cover foil 2 can be easily grasped and peeled off. During this process, the remaining sealed-in tablet 4 remains packaged in a childproof manner and can be easily opened, by grasping the cover foil 2, only after the removal of an intermediary web 9.

As is indicated in FIG. 5 by dotted lines, the tablets 4 can be suitably packaged in strips, where, by a corresponding disposition of the perforations 6, a single package may be separated from the package strip. Such a development of a tablet package guarantees that the package cannot be opened without some special effort, especially not by children without authorization, yet, after separation of an individual package from the entire package, this single package can be easily opened in the usual manner. In the case of the exemplary embodiment shown in FIGS. 5–7, the remaining tablets retain their childproof packaging.

It is to be appreciated that the above-described and illustrated embodiments of childproof packages constructed in accordance with the present invention have been provided as non-limiting examples. Numerous changes may be made in the illustrated embodiments and other embodiments constructed without departing from the spirit and scope of the invention, as defined in the appended claims.

That which is claimed is:

1. A childproof package assembly comprising a base foil made of thermoplastic synthetic material and equipped with deep-drawn cups disposed in a linear array for receiving plural, spaced tablets, dragees or the like therein, said cups being spaced from each other by a planar portion of said base foil, said planar portion having two shallow depressed areas adjacent to each cup and separated from each other by a web portion, perforations disposed at the extremities of said web in a direction transverse to the linear array, a coextensive cover foil lying in a single plane covering said cups and said depressed areas to permit removal of an individual package from the assembly while retaining an adjacent cup inaccessible by the remaining web portion.

* * * * *